US008997426B1

(12) United States Patent
McLeod et al.

(10) Patent No.: US 8,997,426 B1
(45) Date of Patent: Apr. 7, 2015

(54) CEILING PANEL CLIP

(71) Applicant: Price Industries Limited, Winnipeg (CA)

(72) Inventors: Leith McLeod, Winnipeg (CA); David Surminski, Winnipeg (CA); Andrew Bourgeois, Winnipeg (CA); Andrew Grierson, Winnipeg (CA)

(73) Assignee: E.H. Price, Ltd., Winnipeg, Manitobe (CA)

( * ) Notice: Subject to any disclaimer, the term of this patent is extended or adjusted under 35 U.S.C. 154(b) by 0 days.

(21) Appl. No.: 14/069,943

(22) Filed: Nov. 1, 2013

(51) Int. Cl.
*E04B 9/24* (2006.01)

(52) U.S. Cl.
CPC ..... *E04B 9/24* (2013.01)

(58) Field of Classification Search
CPC ..... E04B 9/068; E04B 9/18; E04B 9/26; E04B 9/067; E04B 9/28; E04B 9/22
USPC ..... 52/506.06, 506.07, 508, 772, 773, 774; 24/293–295, 297, 581.11
See application file for complete search history.

(56) References Cited

U.S. PATENT DOCUMENTS

| | | | | | |
|---|---|---|---|---|---|
| 1,793,127 | A | * | 2/1931 | Osius | 52/772 |
| 2,059,483 | A | * | 11/1936 | Parsons | 52/506.06 |
| 3,207,057 | A | * | 9/1965 | Brown et al. | 454/301 |
| 3,248,839 | A | * | 5/1966 | Roberts et al. | 52/506.07 |
| 3,565,473 | A | * | 2/1971 | Kedel | 52/99 |
| 3,594,682 | A | * | 7/1971 | Oleson | 439/100 |
| 4,027,454 | A | * | 6/1977 | Schuplin | 52/714 |
| 4,858,408 | A | * | 8/1989 | Dunn | 52/506.07 |
| 4,873,809 | A | * | 10/1989 | Paul | 52/506.07 |
| 5,885,024 | A | * | 3/1999 | Zupan et al. | 403/389 |
| D421,897 | S | * | 3/2000 | Washecheck et al. | D8/395 |
| 7,062,886 | B2 | * | 6/2006 | Auriemma | 52/506.07 |
| 7,712,274 | B2 | * | 5/2010 | Wendt et al. | 52/506.07 |
| 8,056,294 | B2 | * | 11/2011 | LaLonde | 52/506.09 |
| D652,907 | S | * | 1/2012 | Andrews | D23/393 |

* cited by examiner

*Primary Examiner* — Brian Glessner
*Assistant Examiner* — Adam Barlow
(74) *Attorney, Agent, or Firm* — Smith, Gambrell & Russell

(57) ABSTRACT

A ceiling panel clip to engage the grid structure of a drop ceiling and thereby hold panels of a drop ceiling in place.

14 Claims, 3 Drawing Sheets

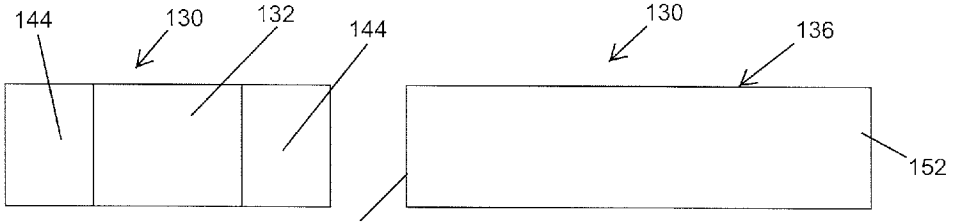
FIG. 6
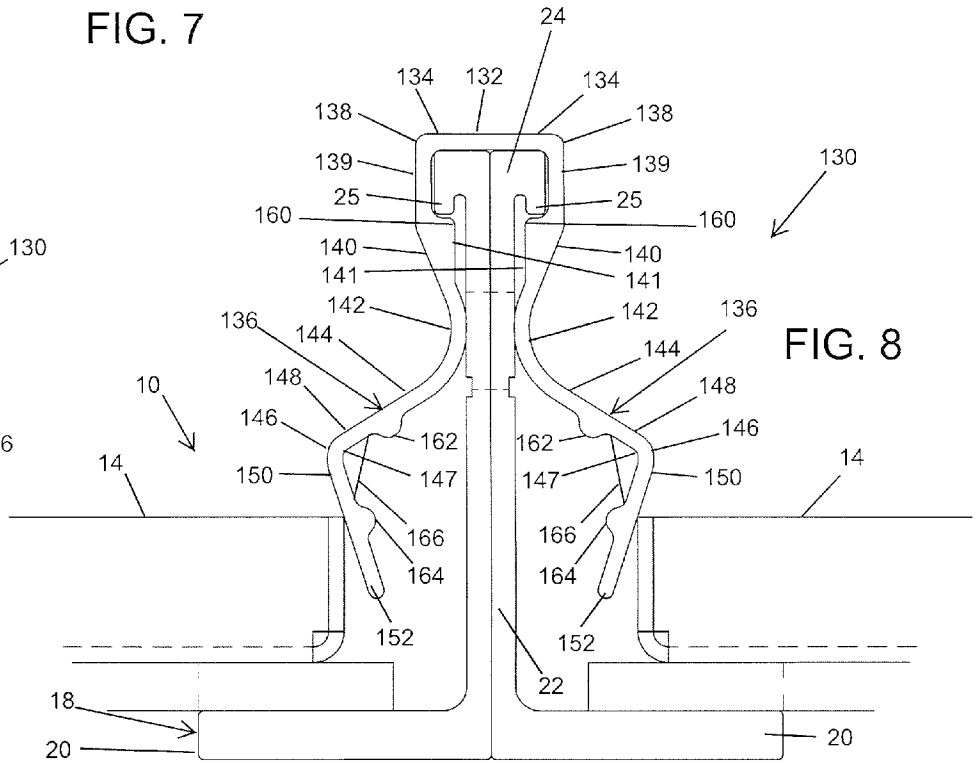
FIG. 7
FIG. 8
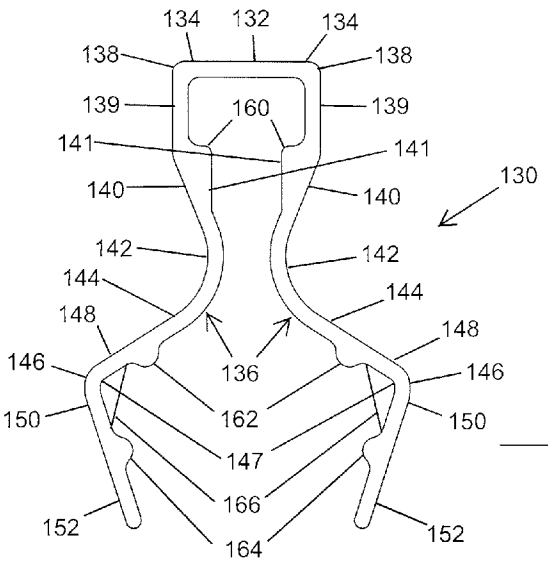
FIG. 5

CEILING PANEL CLIP

FIELD OF THE INVENTION

This invention relates to a drop ceiling and particularly to a ceiling panel clip for holding ceiling panels in place within a drop ceiling support structure.

BACKGROUND OF THE INVENTION

A drop ceiling typically comprises a support structure for supporting ceiling panels of the drop ceiling below an existing ceiling. The support structure includes hangers for suspending ceiling frame members from the existing ceiling. The ceiling frame members, usually in the shape of an inverted T, comprise a vertical web for connection to the hangers and a horizontal web for supporting the ceiling panels on either side of the vertical web. The vertical web includes an enlarged crown with lower crown shoulders. In such a conventional drop ceiling, the panels are often held in place by their own weight or with the use of ceiling panel clips that engage the upper surface of the ceiling panels and hold the panels against the horizontal web of the ceiling frame members.

SUMMARY OF THE INVENTION

The ceiling panel clip of the present invention is easy to install. Particularly, the ceiling panel clip is installed without the necessity of tools and before the ceiling panels are in place. Moreover, the ceiling panel clip of the present invention allows room-side removal and reinstallation of the ceiling panels when access is needed to utilities and wiring installed between the existing ceiling and drop ceiling.

The ceiling panel clip of the present invention is constructed of resilient material, for example spring metal or resilient plastic. The ceiling panel clip is symmetrical and has a horizontal cap segment with two downwardly extending legs attached to the ends of the cap segment. Each leg comprises in series, a cap radius segment connected to one of the ends of the cap segment, an inwardly extending segment connected to the cap radius segment, a gripping radius segment connected to the inwardly extending segment, an outwardly extending segment connected to the gripping radius segment, a keeper radius segment connected to the outwardly extending segment, and an end segment connected to the keeper radius segment.

In a second embodiment of the ceiling panel clip, the keeper radius segment further includes a stiffener web attached to the inside concave surface of the keeper radius segment. The stiffener web extends between the outwardly extending segment and the end segment. In addition, the inwardly extending segment may include an inner guide surface with a clip shoulder. Also, a downwardly extending segment is interposed between the cap radius segment and the inwardly extending segment.

The ceiling panel clip is installed on the vertical web of the ceiling frame member by orienting the legs of the ceiling panel clip on either side of the vertical web and pushing the ceiling panel clip down onto the enlarged crown of the vertical web. The engagement of the outwardly extending segments with the enlarged crown causes the legs of the ceiling panel clip to spread in order for the ceiling panel clip to engage the vertical web with the cap segment of the ceiling panel clip seated on the top of the enlarged crown of the vertical web. Once installed, the cap segment rests on and is coextensive with the crown of the vertical web of the ceiling frame member. The cap radius segments at the ends of the cap segment and the connected inwardly extending segments surround the crown of the vertical web, and the gripping radius segments press against the vertical web, thereby holding the ceiling panel clip in place on the vertical web of the ceiling frame member.

In the second embodiment of the ceiling panel clip, the inner guide surface retains the legs in a spread condition during installation of the ceiling panel clip onto the vertical web of the ceiling frame member, and the clip shoulder engages the lower crown shoulder and locks the ceiling panel clip to the crown of the vertical web of the ceiling frame member.

Once the ceiling panel clip is in place on the crown of the ceiling frame member, a ceiling panel is lowered against the upper portion of the keeper radius segment which acts as a camming surface to push the outwardly extending segment toward the vertical web of the ceiling frame member thereby pushing the gripping radius segment firmly against the vertical web below the crown of the vertical web and causing the gripping radius segment to flex. Once the ceiling panel has passed the outward most portion of the keeper radius segment, the ceiling panel is engaged on its top by the lower portion of the keeper radius segment. The lower portion of the keeper radius segment forms a surface that pushes down on the top of the ceiling panel as the spring action of the gripping radius segment of the ceiling panel clip forces each of the outwardly extending straight segments outward from the vertical web of the ceiling frame member.

In the second embodiment, the stiffening web attached to the inside concave surface of the keeper radius segment stiffens the keeper radius segment so that the keeper radius cannot flex. Consequently, the keeper radius firmly holds the ceiling panel against the horizontal web of the ceiling frame member.

If removal of the ceiling panel is required, pushing upward on the ceiling panel causes the ceiling panel to cam past the lower portion of the keeper radius segment, and the keeper radius segment releases the panel.

Further objects, features and advantages will become apparent upon consideration of the following detailed description of the invention when taken in conjunction with the drawings and the appended claims.

BRIEF DESCRIPTION OF THE DRAWINGS

FIG. 5 is a front elevation view of the resilient plastic ceiling panel clip in accordance with the present invention.

FIG. 6 is a top plan view of the resilient plastic ceiling panel clip in accordance with the present invention.

FIG. 7 is a side elevation view of the resilient plastic ceiling panel clip in accordance with the present invention.

FIG. 8 is a front elevation view of the resilient plastic ceiling panel clip installed in a drop ceiling all in accordance with the present invention.

DETAILED DESCRIPTION OF THE PREFERRED EMBODIMENT

Figure 2:
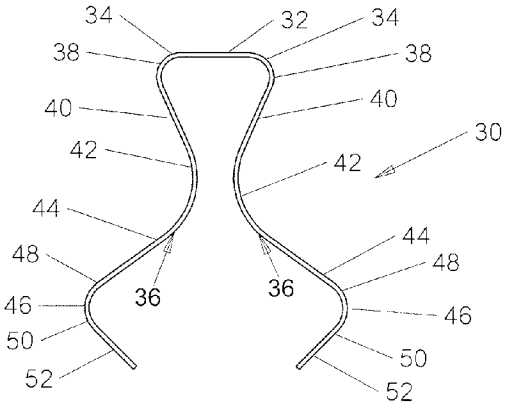
FIG. 2 is a front elevation view of the resilient metal ceiling panel clip as formed in accordance with the present invention.
Figure 3:
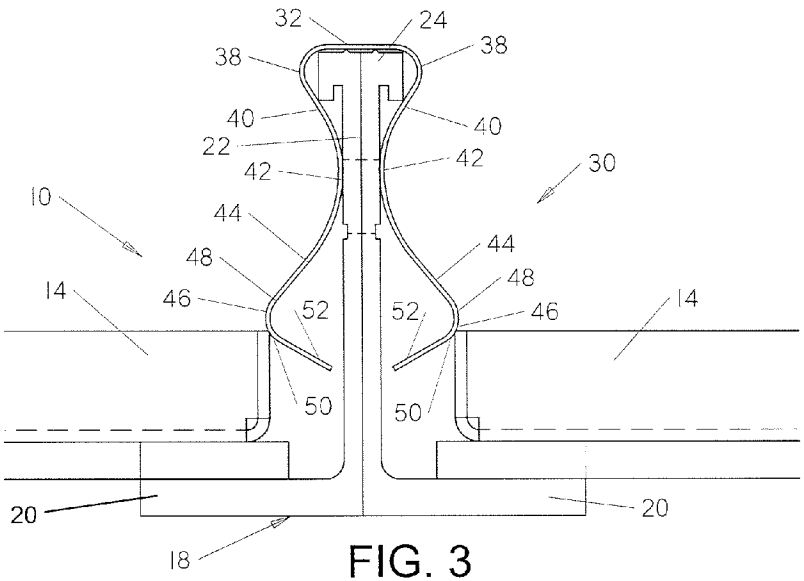
FIG. 3 is a front view of the resilient metal ceiling panel clip installed in a drop ceiling all in accordance with the present invention.
Figure 1:
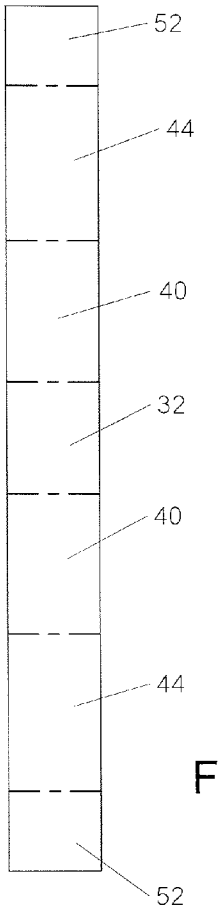
FIG. 1 is a side view of a flat pattern for a resilient metal ceiling panel clip in accordance with the present invention.
Figure 4:
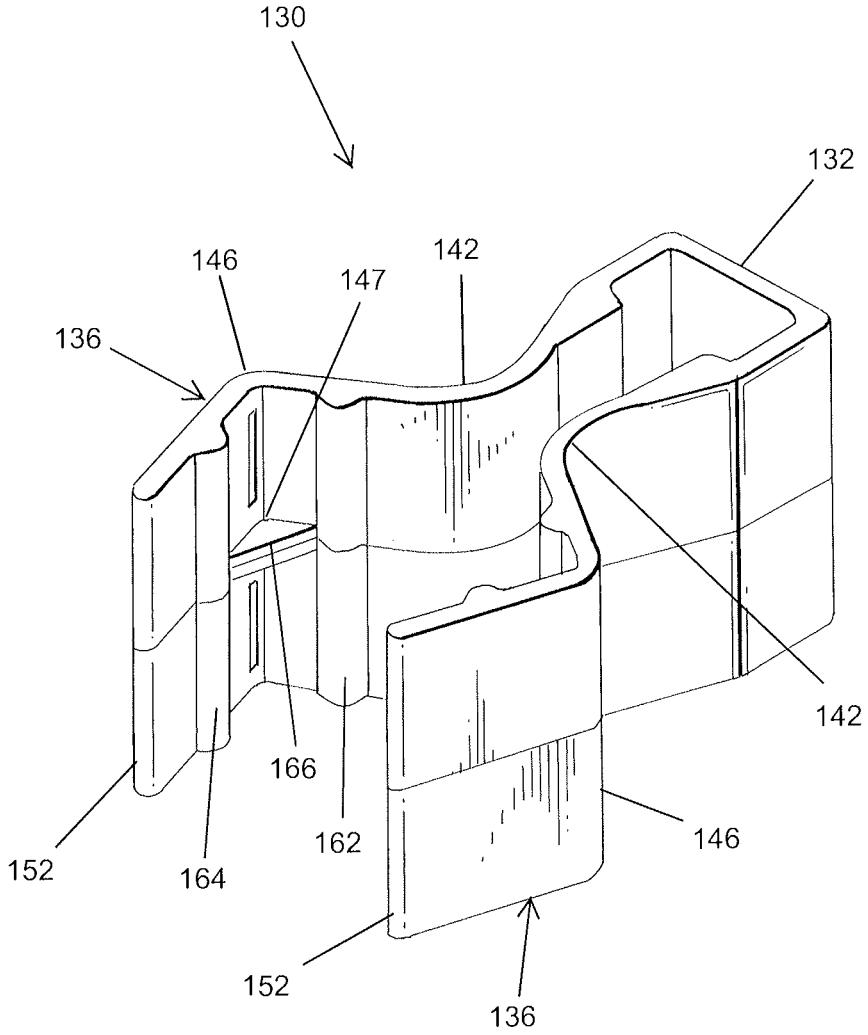
FIG. 4 is a perspective view of a resilient plastic ceiling panel clip in accordance with the present invention.

FIGS. 1-3 illustrate a first embodiment of a ceiling panel clip 30 in accordance with the present invention. FIG. 2 illustrates the ceiling panel clip 30 as formed from a metal blank shown in FIG. 1. The blank in FIG. 1 includes a cap segment 32, inwardly extending segments 40, outwardly extending segments 44, and end segments 52. The blank is preferably made of spring steel, such as 301 stainless steel.

Turning to FIG. 2, the ceiling panel clip 30 as formed includes the cap segment 32 with downward extending symmetrical legs 36. The cap segment 32 has ends 34. Cap radius segments 38 are formed between the cap segment 32 and the inwardly extending segments 40. Likewise, gripping radius segments 42 are formed between the inwardly extending segments 40 and the outwardly extending segments 44. Keeper radius segments 46 are formed between the outwardly extending segments 44 and the end segments 52. The angles formed between the cap segment 32 and the inwardly extending segments 40 are acute angles, preferably about 66°. The angles formed between the inwardly extending segments 40 and the outwardly extending segments 44 are obtuse angles, preferably about 102°. The angles formed between the outwardly extending segments 44 and the end segments 52 are approximately right angles, preferably about 81°.

FIG. 3 shows the ceiling panel clip 30 installed in a drop ceiling 10. Particularly, the drop ceiling 10 includes a support structure consisting of elongated ceiling frame members 18 having an inverted T-shaped cross section and ceiling panels 14. The ceiling frame members 18 include a horizontal web 20 for supporting the ceiling panels 14 and a vertical web 22 topped by a crown 24. The ceiling frame members are suspended from an existing ceiling by means of hangers (not shown) attached between the vertical web 22 and the existing ceiling.

In connection with installing the drop ceiling panels 14 using ceiling panel clips 30, the elongated ceiling frame members 18 are first installed by using hangers (not shown) to suspend the ceiling frame members 18 from the existing ceiling to create a grid of ceiling frame members constituting the support structure for the ceiling panels 14. Once the grid is in place, the ceiling panel clips 30 are installed along the length of the ceiling frame members 18. Installation of the ceiling clip 30 is accomplished by positioning the legs of 36 on either side of the vertical web 22 of the ceiling frame member 18. The ceiling clip 30 is then pushed downward so that the crown 24 spreads the legs 36 by means of a caroming action of the gripping radius segments 42 against the crown 24. Once the gripping radius segments 42 have passed below the crown 24, the legs 36 spring together in order to surround the crown 24 and lock the ceiling panel clip 30 to the vertical web 22 of the frame member 18.

With the ceiling panel clips 30 in place on the vertical web 22 of the frame member 18, the ceiling panels 14 are lowered into place. As the ceiling panels 14 are lowered toward the supporting horizontal web 20, the lower edges of the ceiling panels 14 engage the upper portions 48 of the keeper radius segments 46. The camming action of the upper portions 48 of the keeper radius segments 46 pushes the keeper radius segments 46 toward the vertical web 22 thereby allowing the ceiling panel 14 to pass by the outwardly extending portion of the keeper radius segments 46 and engage the horizontal support web 20. Once the ceiling panel 14 passes the outwardly extending portion of the keeper radius segments 46, the top of the ceiling panel 14 engages the lower portions 50 of the keeper radio segments 46. The outward spring action of the ceiling panel clip 30 causes the lower portions 50 of the keeper radius segments 46 to exert a downward force on the ceiling panel 14 thereby holding the ceiling panel 14 in contact with the horizontal support web 20.

In the event that access to the space between the existing ceiling and the drop ceiling 10 is required, the ceiling panels 14 can be removed by pushing up on the edges of the ceiling panels 14. When an upward force is exerted at the edge of the ceiling panels 14 adjacent the ceiling panel clip 30, the upward pressure of the top of the ceiling panels 14 on the lower portions 50 of the keeper radius segments 46 produces a camming action that causes the keeper radius segments 46 to move inwardly allowing the ceiling panels 14 to pass by the keeper radius segments 46.

FIGS. 4-8 illustrate a second embodiment of a ceiling clip 130 in accordance with the present invention. The ceiling clip 130 is constructed of a resilient plastic and is formed by injection molding a medium viscosity polymer.

Turning to FIGS. 4-8, the ceiling panel clip 130 includes a cap segment 132 with downward extending symmetrical legs 136. The cap segment 132 has ends 134. Cap radius segments 138 are formed between the cap segment 132 and downwardly extending segments 139. Inwardly extending segments 140 are connected to the downwardly extending segments 139 and extend downwardly and inwardly from the downwardly extending segments 139. The inwardly extending segments 140 include inner guide surfaces 141 with shoulders 160. Gripping radius segments 142 are connected between the inwardly extending segments 140 and the outwardly extending segments 144. Keeper radius segments 146 are formed between the outwardly extending segments 144 and the end segments 152. The angles formed between the cap segments 132 and the inwardly extending segments 140 are acute angles, preferably about 66°. The angles formed between the inwardly extending segments 140 and the outwardly extending segments 144 are obtuse angles, preferably about 102°. The angles formed between the outwardly extending straight segments 144 and the end segments 152 are approximately 81°.

The ceiling panel clip 130 also includes upper nubs 162 protruding from the inside of the outwardly extending segments 144 and lower nubs 164 protruding from the inside of the end segments 152. The nubs 162 and 164 are for mold ejector pins to engage the ceiling panel clip 130 and thereby to help facilitate mold release during fabrication. Stiffener webs 166 are attached to inside concave surfaces 147 of the keeper radius segments 146 and extend between the outwardly extending segments 144 and the end segments 152.

FIG. 8 shows the ceiling panel clip 130 installed in a drop ceiling 10. Particularly, the drop ceiling 10 includes a support structure consisting of elongated ceiling frame members 18 having an inverted T-shaped cross section and ceiling panels 14. The ceiling frame members 18 include horizontal webs 20 for supporting the ceiling panels 14 and a vertical web 22 topped by a crown 24. The crown 24 includes crown shoulders 25. The ceiling frame members are suspended from an existing ceiling by means of hangers (not shown) attached between the vertical web 22 and the existing ceiling.

In connection with installing the drop ceiling panels 14 using the ceiling panel clips 130, the elongated ceiling frame members 18 are first installed by using hangers (not shown) to suspend the ceiling frame members 18 from the existing ceiling to create a grid of ceiling frame members constituting the support structure for the ceiling panels. Once the grid is in place, the ceiling panel clips 130 are installed along the length of the ceiling frame members 18. Installation of the ceiling clip 130 is accomplished by positioning the legs of 136 on either side of the vertical web 22 of the ceiling frame member 18. The ceiling clip 130 is then pushed downward so that the crown 24 spreads the legs 136 by means of a camming action of the gripping radius segments 142 against the crown 24.

Once the gripping radius segments 142 have passed below the crown 24, the inner guide surfaces 141 maintain the legs 136 in a spread condition until the clip shoulders 160 of the legs 136 have cleared the crown shoulders 25. Once the clip shoulders 160 have cleared the crown shoulders 25, the legs 136 spring together in order to surround the crown 24 and lock the ceiling panel clip 130 to the vertical web 22 of the frame member 18 by means of engagement between the crown shoulders 25 and the clip shoulders 160.

With the ceiling panel clips 130 in place on the vertical web 22 of the frame member 18, the ceiling panels 14 are lowered into place. As the ceiling panels 14 are lowered toward the supporting horizontal web 20, the lower edges of the ceiling panels 14 engage upper portions 148 of the keeper radius segments 146. The camming action of the upper portions 148 of the keeper radius segments 146 pushes the keeper radius segments 146 toward the vertical web 22 thereby allowing the ceiling panels 14 to pass by the outwardly extending portions of the keeper radius segments 146 and to engage the horizontal support webs 20. Once the ceiling panels 14 pass the outwardly extending portions of the keeper radius segments 146, the tops of the ceiling panels 14 engage the lower portions 150 of the keeper radio segments 146. The outward spring action of the ceiling panel clip 130 about the gripping radius segments 142 causes the lower portions 150 of the keeper radius segments 146 to exert a downward force on the ceiling panels 14 thereby holding the ceiling panels 14 in contact with the horizontal support webs 20. The stiffening webs 166 limit the flexing of the keeper radius segments 146. Therefore, the end segments 152 cannot be displaced upwardly with respect to the outwardly extending segments 144 thereby assuring that the panels 14 are securely held in place.

In the event that access to the space between the existing ceiling and the drop ceiling 10 is required, the ceiling panels 14 can be removed by pushing up on the edges of the ceiling panels 14. When an upward force is exerted at the edge of the ceiling panels 14 adjacent the ceiling panel clip 130, the upward pressure of the top of the ceiling panels 14 on the lower portions 150 of the keeper radius segments 146 produces a camming action that causes the keeper radius segments 146 to move inwardly as the gripping radius segments 142 flex and thereby allowing the ceiling panels 14 to pass by the keeper radius segments 146.

While this invention has been described with reference to preferred embodiments thereof, it is to be understood that variations and modifications can be affected within the spirit and scope of the invention as described herein and as described in the appended claims.

We claim:

1. A ceiling panel clip for securing a ceiling panel, with a lower edge and a top, to an elongated ceiling frame member having an inverted T-shaped cross-section, the ceiling panel clip comprising:

a. a cap segment having a length with ends; and b. a pair of resilient legs attached to the ends of the cap segment, each leg comprising in series:

i. a cap radius segment connected to one end of the cap segment;

ii. an inwardly extending segment connected to the cap radius segment;

iii. a gripping radius segment connected to the inwardly extending segment;

iv. an outwardly extending segment connected to the gripping radius segment;

v. a keeper radius segment, with an inside concave surface, connected to the outwardly extending segment by a camming upper portion; and vi. an inwardly extending end segment connected to the keeper radius segment by a camming lower portion, wherein the lower edge of the ceiling panel engages the camming upper portion of the keeper radius segment to push the keeper radius segment toward the ceiling frame member to allow the ceiling panel to move to a position below the keeper radius segment and wherein the top of the ceiling panel engages the camming lower portion of the keeper radius segment to push the keeper radius segment toward the ceiling frame member to allow the ceiling panel to move to a position above the keeper radius segment.

2. The ceiling panel clip of claim 1, wherein the ceiling panel clip further comprises a downwardly extending segment interposed between the cap radius segment and the inwardly extending segment.

3. The ceiling panel clip of claim 1, wherein the inwardly extending segment has an inner guide surface with a clip shoulder.

4. The ceiling panel clip of claim 1, wherein the ceiling panel clip further comprises a stiffening web attached to the inside concave surface of the keeper radius segment between the outwardly extending segment and the end segment.

5. The ceiling panel clip of claim 1, wherein a first angle formed between the inwardly extending segment and the cap segment is an acute angle, a second angle formed between the inwardly extending segment and the outwardly extending segment is an obtuse angle, and a third angle formed between the outwardly extending segment and the end segment is approximately a right angle.

6. The ceiling panel clip of claim 1, wherein the ceiling panel clip is constructed of resilient metal.

7. The ceiling panel clip of claim 1, wherein the ceiling panel clip is constructed of resilient plastic.

8. A drop ceiling comprising:

a. a support structure comprising, i. ceiling frame members each comprising a horizontal web and a vertical web wherein the horizontal web and the vertical web are in the shape of an inverted T, and the vertical web has an enlarged crown with crown shoulders; and ii. hangers for connecting the ceiling frame members to an existing ceiling;

b. ceiling panels, with lower edges and tops, supported by the horizontal web of the ceiling frame members, and c. ceiling panel clips for securing the ceiling panels to the horizontal webs, each ceiling panel clip comprising, i. a cap segment having a length with ends; and ii. a pair of resilient legs attached to the ends of the cap, each leg comprising in series:

(1) a cap radius segment connected to one end of the cap segment;

(2) an inwardly extending segment connected to the cap radius segment;

(3) a gripping radius segment connected to the inwardly extending segment;

(4) an outwardly extending segment connected to the gripping radius segment;

(5) a keeper radius segment with an inside concave surface connected to the outwardly extending segment by a camming upper portion; and (6) an inwardly extending end segment connected to the keeper radius segment by a camming lower portion, wherein the cap segment and the inwardly extending segments surround the crown of the vertical web and thereby secure the ceiling panel clips to the vertical webs, wherein the lower edges of the ceiling panels engage the camming upper portions of the keeper radius segments to push the keeper radius segments toward the vertical web to allow the ceiling panels to move to a position below the keeper radius segments, and wherein the tops of the ceiling panels engage the camming lower portions of the keeper radius segments to push the keeper radius segments toward the vertical web to allow the ceiling panels to move to a position above the keeper radius segments.

9. The drop ceiling of claim 8, wherein the ceiling panel clip further comprises a downwardly extending segment interposed between the cap radius segment and the inwardly extending segment.

10. The drop ceiling of claim 8, wherein the inwardly extending segment has an inner guide surface with a clip shoulder, wherein the inner guide surface engages the crown to spread the legs during attachment of the ceiling panel clip to the vertical web, and wherein the clip shoulder engages the crown shoulder to secure the ceiling panel clip to the vertical web.

11. The drop ceiling of claim 8, wherein the ceiling panel clip further comprises a stiffening web attached to the inside concave surface of the keeper radius segment between the outwardly extending segment and the end segment.

12. The drop ceiling of claim 8, wherein the ceiling panel clip is constructed of resilient metal.

13. The drop ceiling of claim 8, wherein the ceiling panel clip is constructed of resilient plastic.

14. The drop ceiling of claim 8, wherein a first angle formed between the inwardly extending segment and the cap segment is an acute angle, a second angle formed between the inwardly extending segment and the outwardly extending segment is an obtuse angle, and a third angle formed between the outwardly extending segment and the end segment is approximately a right angle.

* * * * *